US005168480A

United States Patent [19]

Dodier

[11] Patent Number: 5,168,480

[45] Date of Patent: Dec. 1, 1992

[54] WATCH ACCESSORY

[76] Inventor: Louise Dodier, 3295 Antoine Page, St. Hubert, Quebec, Canada, J3Y 8V9

[21] Appl. No.: 777,596

[22] Filed: Oct. 16, 1991

[51] Int. Cl.[5] ..... G04B 37/00

[52] U.S. Cl. ..... 368/282; 224/164; 224/173

[58] Field of Search ..... 368/28, 281–283, 368/286; 224/164, 165, 173, 174; 63/21–23

[56] References Cited

U.S. PATENT DOCUMENTS 2,541,432 2/1951 Muehlbauer ..... 324/165
2,679,785 6/1954 Batt ..... 368/283
3,111,247 11/1963 Just ..... 368/286

*Primary Examiner*—Vit W. Miska

[57] ABSTRACT

A wrist-watch accessory comprising a hollow open-ended cylinder and a pair of flat spaced-apart, generally parallel legs protruding from one side of the cylinder in superposed relation. The loop of the wrist band of the watch has an opening in which the cylinder is inserted to surround the push pin retaining the wrist band to the wrist-watch. The outer and inner legs are in contact with the outer and inner faces of the wrist band. A decoration can be applied on the outer leg. Either one of the two legs can bear an identification or medical alert label.

5 Claims, 1 Drawing Sheet

WATCH ACCESSORY

FIELD OF THE INVENTION

This invention relates to wristwatch or wristband accessories. It is a removable piece which is connected to the wristwatch via the pushpin, namely the pin connecting the wristband to the watch.

BACKGROUND OF THE INVENTION

Using the current methods, wristwatch owners can only modify the appearance of their wristwatches by changing the wristbands or by changing the protective watch cover. The flexibility of these methods suffers because both wristbands and watch covers are made in many shapes and sizes and one must fit these items to each particular wristwatch individually. Furthermore, he who desires making some additions to the wristwatch cannot do so using today's methods without having a wristband or wristwatch made on contract by a specialist.

OBJECTS OF THE INVENTION

It is the main object of the present invention to provide an accessory which is not permanently fixed to either the watch or the wrist band and, therefore, can be removed from one wrist-watch and installed on another.

It is another object of the present invention to provide such an accessory which can add special creative touches to most conventional wrist-watches and or which can have a functional application, such as to constitute a medical alert tag that informs the public of special medical symptoms that must be respected during emergencies.

SUMMARY OF THE INVENTION

The wrist-watch accessory of the invention comprises a hollow open-ended cylinder for slidably receiving the push pin of a wrist-watch and a pair of flat, spaced-apart, generally parallel legs protruding from one side of said cylinder in superposed relation, both legs usually having a width greater than the length of said cylinder. The end loop of the watch band is provided with an opening through which the cylinder is inserted with the two legs in contact with the outer and inner faces of the wrist band and with the push pin inserted through the loop and the cylinder. The invention is also directed to the combination of a wrist-watch with the above-noted accessory.

BRIEF DESCRIPTION OF THE DRAWINGS

In the drawings which illustrate the accessory.

DETAILED DESCRIPTION OF A PREFERRED EMBODIMENT

Figure 1:
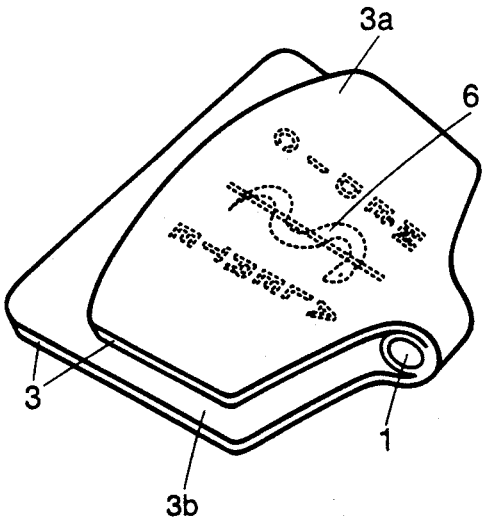
FIG. 1 is a perspective view of the accessory to be installed onto the watch.
Figure 2:
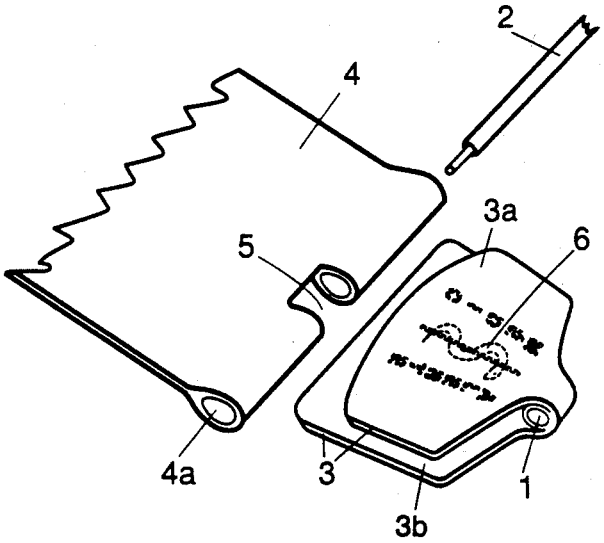
FIG. 2 is an exploded perspective view of the wristband, the pushpin, and the accessory.
Figure 3:
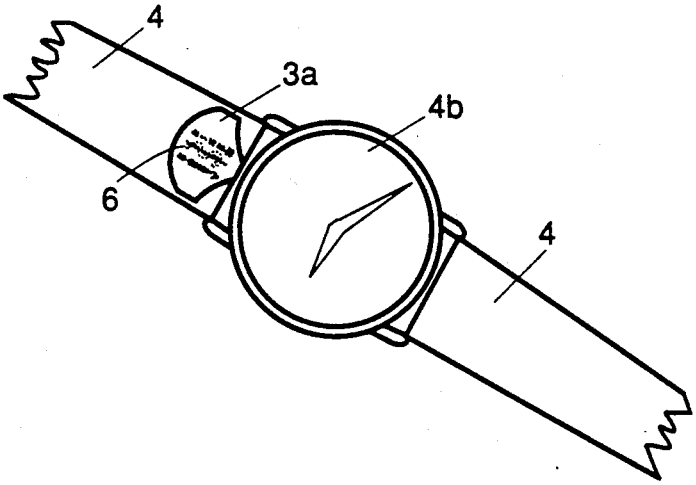
FIG. 3 shows the accessory fully installed on the wristwatch.

This accessory is comprised of a hollow open-ended cylinder 1, with the internal diameter slightly larger than the diameter of the conventional pushpin 2 which serves to attach wrist band 4 to wrist-watch case 4*b*. A U-shaped stopper element 3 surrounds cylinder 1 and is fixed to it. Stopper 3 consists of an outer leg 3*a* and of an inner leg 3*b* which protrude from one side of cylinder 1. Legs 3*a* and 3*b* are flat, spaced apart and generally parallel to each other and in superposed relation. Both legs usually have a width greater than the length of the cylinder. In the embodiment shown, both legs 3*a* and 3*b* are substantially co-extensive and extend above and below the wristband 4 to prevent the acessory from rotating. Stopper element 3 and cylinder 1 can be molded into one piece. The end loop 4*a* of wristband 4 must contain an opening 5 where cylinder 1 is to be inserted to receive pushpin 2. The width and depth of opening 5 in the wristband loop 4*a* must be sufficiently large so that the cylinder 1 can be inserted into opening 5 and the pushpin 2 can traverse both the wristband loop 4*a* and the cylinder 1. The legs 3*b* must exceed the dimensions of the opening 5 in the wristband 4.

An identification and/or alert label can be applied to one or both of the legs 3*a* as shown, 6. This eliminates the necessity of wearing a separate identification bracelet.

I claim:

1. An accessory for a wrist-watch of the type including a wrist-watch case, a wrist band and a push pin retaining the wrist band to the wrist-watch case, said accessory comprising a hollow open-ended cylinder for slidably receiving said push pin and a pair of flat, spaced-apart, generally parallel legs protruding from one side of said cylinder in superposed relation, each leg usually having a width greater than the length of said cylinder, said legs adapted to contact the opposite sides of said wrist band, whereby said accessory is positively retained on said push pin by said cylinder and is prevented from rotation by said two legs relative to said wrist band.

2. An accessory as defined in claim 1 wherein said legs and said cylinder are molded into one piece.

3. An accessory as defined in claim 1 wherein said outer leg bears an identification or decoration.

4. An accessory as defined in claim 1 wherein said inner leg bears an identification.

5. The combination of a wrist-watch accessory with a wrist-watch including a case, a wrist band having an end loop and a push pin inserted through said end loop and retaining said wrist band to said case, said end loop having an opening, said accessory comprising a cylinder fitted into said opening and surrounding said push pin, and a pair of flat, spaced-apart, generally parallel legs protruding from one side of said cylinder in superposed relation, each leg usually having a width greater than the length of said cylinder and contacting the opposite sides of said wrist band, whereby said accessory is positively retained on said push pin by said cylinder and is prevented from rotation by said two legs relative to said wrist band.

* * * * *